United States Patent [19]

Sellers

[11] Patent Number: 4,532,782

[45] Date of Patent: Aug. 6, 1985

[54] APPARATUS FOR PAD BATCH DYEING OF TUBULAR KNITTED COTTON FABRICS

[75] Inventor: John R. Sellers, Davidson, N.C.

[73] Assignee: Samcoe Holding Corporation, Woodside, N.Y.

[21] Appl. No.: 596,615

[22] Filed: Apr. 4, 1984

[51] Int. Cl.[3] ..... D06B 3/18

[52] U.S. Cl. ..... 68/13 R; 68/22 R; 68/43; 68/175

[58] Field of Search ..... 68/13 R, 22 R, 43, 158, 68/175

[56] References Cited

U.S. PATENT DOCUMENTS

| | | | |
|---|---|---|---|
| 2,045,755 | 6/1936 | Cohn . | |
| 2,189,914 | 2/1940 | Mellor et al. | 68/43 X |
| 2,239,636 | 4/1941 | Weiss | 68/22 R X |
| 2,849,784 | 9/1958 | Adams . | |
| 2,858,689 | 11/1958 | Smith | 68/99 |
| 2,963,893 | 12/1960 | Kusters | 68/175 |
| 2,977,662 | 4/1961 | Freeze et al. | 68/22 R X |
| 3,207,616 | 9/1965 | Cohn et al. . | |
| 3,412,411 | 11/1968 | Cohn et al. | 8/151 |
| 3,692,465 | 9/1972 | Cohn et al. | 68/22 R X |
| 3,995,457 | 12/1976 | Kinomoto et al. | 68/22 R X |

FOREIGN PATENT DOCUMENTS

| | | | |
|---|---|---|---|
| 578308 | 6/1933 | Fed. Rep. of Germany . | |
| 591474 | 1/1934 | Fed. Rep. of Germany . | |
| 595566 | 4/1934 | Fed. Rep. of Germany | 68/43 |
| 607805 | 1/1935 | Fed. Rep. of Germany | 68/22 R |
| 23531 | 5/1956 | Fed. Rep. of Germany | 68/175 |
| B 37417 | 10/1956 | Fed. Rep. of Germany . | |
| 1175529 | 11/1958 | France . | |
| 4785 | 6/1956 | Japan . | |
| 1115612 | 5/1968 | United Kingdom . | |

*Primary Examiner*—Philip R. Coe

*Attorney, Agent, or Firm*—Mandeville and Schweitzer

[57] ABSTRACT

The disclosure relates to an apparatus and method for pad batch dyeing of tubular knitted fabrics of substantial cotton content, typically 50% or more. One or more connected strings of tubular knitted fabric are advanced toward the dyeing apparatus, where the fabric is gripped across its full width and positively advanced toward the dye solution. A ring guide spreader is positioned in close coupled relation to the driven entry roller and spreads the fabric to flat form and to its natural greige width. Closely coupled to the ring guide means is a dye pad station comprising a pair of horizontally opposed, resilient squeeze rollers, a treating roller forming a submerged dye nip with the front squeeze roller, and a submerged guide roller to receive the fabric as it travels in a downward incline through the dye nip and redirect it to a vertically upward path for passage through the squeeze nip. The squeeze rollers are submerged in the dye liquor to a depth less than half their diameter, so that fabric exits from the dye bath in traveling to the squeeze nip. An exit guide roller is provided directly above the squeeze nip, to guide the dyed fabric symmetrically away from the nip. The submerged treating roller and submerged guide roller are mounted within and by a solution pan for containing the dye, providing unique advantages in terms of mechanical simplicity, facility of clean out and restart for successive batch operations, and processing efficiency. Substantial cost and operating benefits are realized.

21 Claims, 11 Drawing Figures

F
28
27
30
170
F
58
102
60
55
32
40
31
34
97
35
93
59
103
95
94
61
54
36
33
57
101
100
100

F
170
58
10
35
57
52
68
51
32
56
66
31
34
42
53
97
41
40
110
65
9
71
96
93
91
95
102
43
120
92
7
61
50
94
44
33
54
101
100

58
170
55
56
67
65
85
75
76
77
73
74
72
34
70
71
80
35
83
82
81
84
31

APPARATUS FOR PAD BATCH DYEING OF TUBULAR KNITTED COTTON FABRICS

BACKGROUND AND SUMMARY OF THE INVENTION

Dyeing of tubular knitted fabric has been carried out predominantly with beck dyeing procedures, which are capable of producing quite satisfactory results, but tend to be somewhat capital intensive and inefficient in terms of labor costs, energy costs, effluent disposal problems, etc. Pad batch dyeing, wherein tubular knitted fabric is passed through a low volume of bath of dye solution and subjected to one or more stages of rolling pressure, has been known for some time and has seemingly obvious production advantages. Nevertheless, it has achieved only relatively modest commercial acceptance in the past for tubular fabrics. Recent substantial advances in the art of dye chemistry have begun to make available dyes that are more adequately suited to application by pad dyeing procedures. Nevertheless, for tubular knitted fabrics of 100% cotton, or blends of a high percentage (50% or more) of cotton, pad dyeing has been regarded as relatively unsatisfactory by the industry largely because of potential problems with edge marking.

Edge marking, in pad dyeing of tubular knitted cotton-based fabrics can occur for a number of reasons. Thus, when tubular knitted fabric is processed in tubular form, it typically is handled in flat, two-layered configuration. At the edge extremities, stresses and strains upon the fabric, and specific operating conditions, may differ from other areas of the fabric, resulting in edge lines, which may be either lighter or darker in color. The presence of such edge lines makes the fabric commercially unsuitable, or at least of significantly lower quality than desired by the manufacturer.

In the past, equipment available for pad batch dyeing typically has been either excessively prone to edge marking problems or unduly costly and complex as a result of attempting to avoid such markings. Accordingly, in the past, pad batch dyeing of tubular knitted cotton fabric has not enjoyed significant success.

With the availability of improved dyestuffs, however, greater opportunities exist for the utilization of pad batch dyeing procedures, provided the equipment is sufficiently simple and reliable, and provided that the equipment can be operated in a production plant environment, by relatively low skilled labor, without excessive problems such as edge marking.

In accordance with the present invention, a significantly improved pad batch dyeing apparatus is provided, in which the dyeing facility proper comprises a pair of resiliently covered squeeze rollers, arranged as a horizontally opposed pair, which are disposed partially within a dye solution pan, such that the squeeze rollers are partially submerged in the solution in the pan, but to a level substantially less than one half the diameter of the rollers. A single submerged resilient treating roller is mounted not only within the solution pan, but indeed by the pan itself, for rolling pressure contact with the front squeeze roller. A guide roller is also mounted within and by the solution pan, in a position to guide the fabric out of the nip formed by the submerged treating roller and the front squeeze roller and to redirect the fabric upward toward the squeeze nip, formed by the horizontally opposed pair of squeeze rollers. The arrangement provides for a single submerged pressure nip, hereinafter sometimes referred to as a dye nip, and for a single submerged guide roller which serves first to convey the fabric away from the dye nip, free of contact with the front squeeze roller, and then to redirect the fabric symmetrically into the squeeze nip in such manner that the fabric does not come into contact with one of the squeeze rollers significantly prior to contact with the other.

Pursuant to one aspect of the invention, operating pressure at the dye nip is provided by pressure actuator means, typically fluid actuators, acting upon the solution pan, which is pivoted adjacent the front squeeze roller. During normal operations, the solution pan is controllably urged upward and causes the submerged treating roller to be pressed into controlled pressure contact with the front squeeze roller to provide a submerged dye nip. At the conclusion of a batch dyeing operation, the actuator means is retracted, to pivot the pan, and the rollers mounted therein, downwardly. The leftover dye liquor may then be easily flushed and cleaned from the pan and from the rollers in preparation for a subsequent operation. In addition, this arrangement greatly facilitates the subsequent threading into the apparatus of a new fabric string. Thus, it becomes significantly more economical to run shorter dye lots and, indeed, it becomes practical to run several lots in a normal day's production.

In accordance with another aspect of the invention, the apparatus advantageously incorporates a ring guide spreader arrangement upstream of and in closely coupled relation to the dye nip. Directly upstream from the ring guide spreader, and in close coupled relation with the spreader, is a controllably driven entry feed roller arranged to engage the incoming fabric across its full width and to advance the fabric under positive driving control. This arrangement enables the fabric to be furnished to the ring guide spreader relatively free of lengthwise tension, and enables the fabric to be adjusted by the ring guide spreader to flat, two-layered form and substantially to its normal width. In particular, the fabric is not spread significantly beyond its natural greige width, so that the fabric enters the dye solution with minimum geometrical distortions.

In accordance with a further significant aspect of the invention, the geometrical arrangement of the ring guide spreader and the submerged dye nip is such that the fabric leaving the ring guide spreader proceeds directly into the dye nip, along an entry plane which is approximately at right angles to the plane defined by the axis of the front squeeze roller and the submerged treating roller. Further, the fabric is not diverted by any intervening guide means in its travel from the ring guide spreader to the submerged dye nip, thus avoiding any tendency for the fabric edges to be curled in advance of the dye nip. Likewise, the location of the submerged guide roller advantageously is such as to guide the fabric symmetrically out of the submerged dye nip, and then symmetrically upward into the squeeze nip.

To advantage, the squeeze nip is located above the level of the dye solution, although the lower portions of the squeeze rollers are submerged in the solution. This not only enables the volume of dyestuff in the solution pan to be minimized but provides for an advantageous cascading effect of the dye liquor along the vertically rising fabric, as it emerges from the dye solution and travels upward to the squeeze nip. A further guide roller is advantageously provided at a location spaced well above the squeeze nip, arranged to guide the fabric symmetrically out of that nip.

As a further aspect of the invention, the apparatus of the invention incorporates a solution pan, which is pivoted adjacent the front squeeze roller and is geometrically arranged to conform closely to the contours of the submerged treating roller and then to extend more or less in tangency to the back squeeze roller. One advantage of this configuration is its relatively minimum volumetric capacity, which is important in terms of the dye chemistry. In this regard, dyes currently being made available that are suitable for pad batch dyeing processes are fiber reactive dyes used with a relatively high alkali content, some of which dyes have an extremely short stability, perhaps as little as five minutes. Accordingly, even though the dyestuff is mixed immediately prior to being suplied to the solution pan, it is important to maintain minimum volumetric capacity of the solution pan in order to assure utilization of the dyestuff while it remains stable. Additionally, the configuration of the solution pan as described, greatly facilitates rapid cleanup and turn-around of the apparatus at the end of a batch dyeing operation.

Among the rather unique features of the new apparatus are that it incorporates only a single submerged treating nip and a single submerged guide roller, both mounted and arranged in a unique manner. A number of advantages are derived from this arrangement. First, the equipment cost is kept at a relative minimum. Second, the basic simplicity of the equipment makes it suitable for day in, day out production operation by production personnel. Third, the equipment can be most expeditiously cleaned and readied for subsequent operations. Altogether, these advantages make the equipment ideally suited as a production apparatus for pad batch dyeing of cotton fabrics and cotton blends of tubular knitted construction.

For a more complete understanding of the above and other features and advantages of the invention, reference should be made to the following detailed description of a preferred embodiment and to the accompanying drawings.

DESCRIPTION OF A PREFERRED EMBODIMENT

Figure 1:
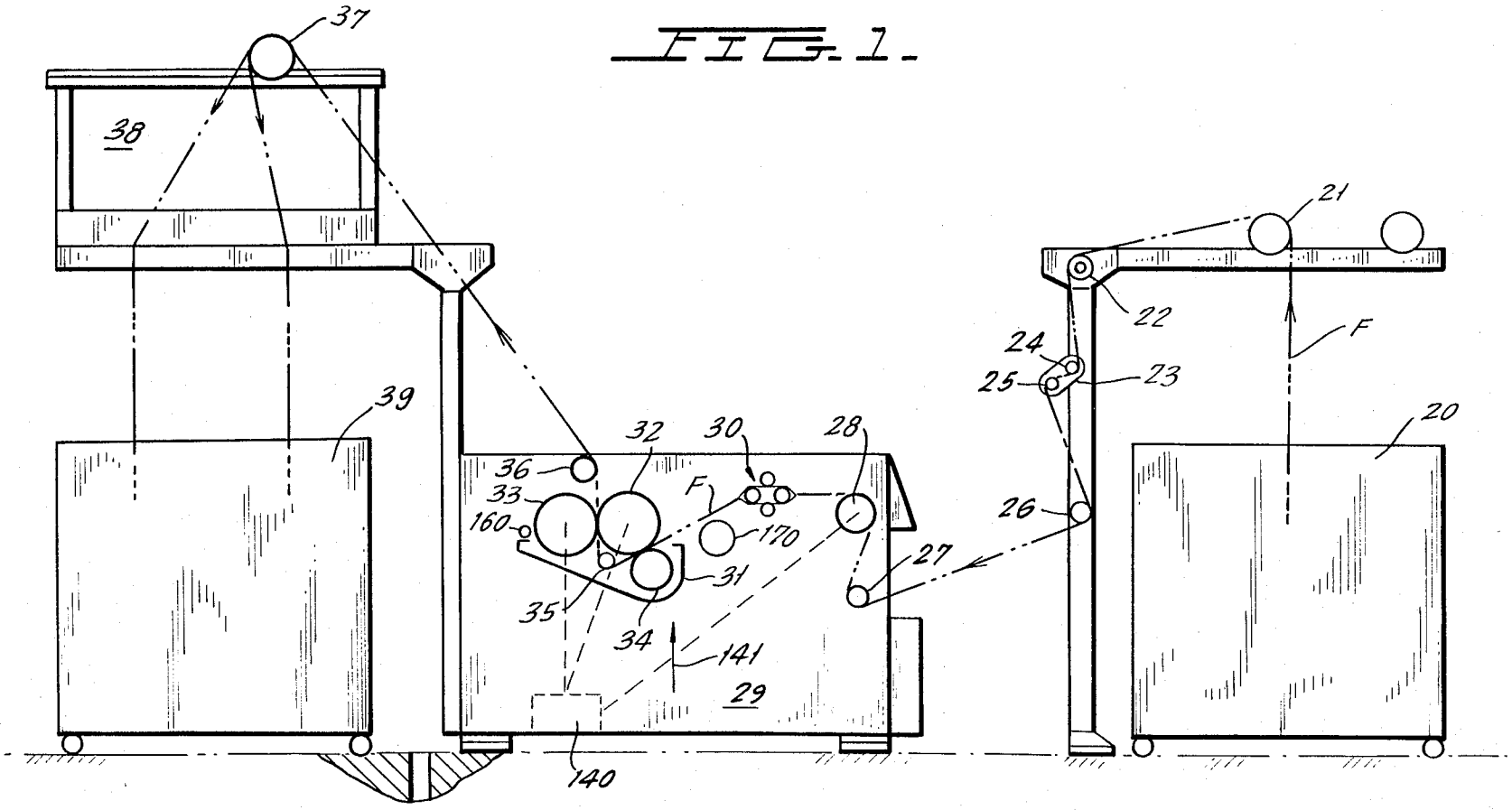
FIG. 1 is a simplified, schematic representation of a complete pad batch dyeing system arranged in accordance with the principles of the invention.

Referring now to the drawing, and initially to FIG. 1, the reference numeral 20 represents a supply container, in which is received a batch supply of cotton-based tubular knitted fabric ready for processing. Within the contemplation of the invention, the fabric, designated by the reference letter F, will be either 100% cotton, or a blend of at least about 50% cotton, typically with polyester. The fabric batch within the container 20 may comprise a plurality of individual fabric lengths, sewed together end to end for continuity of processing. The individual fabric sections may be of different widths.

The fabric F supplied in the container 20 will, according to the invention, be in substantially dry condition, and desirably in relatively flat form, typically plaited into the container in a previous operation.

The fabric F is drawn from the container 20 upward over a guide roller 21 and forwardly to a guide roller 22. The fabric then is directed through a tension bar straightener 23, which is adjustably rotatable to divert the fabric under and over rods 24, 25, to apply a slight degree of longitudinal tension to the fabric, attending to flatten the fabric and maintain it under proper control.

Figure 6:
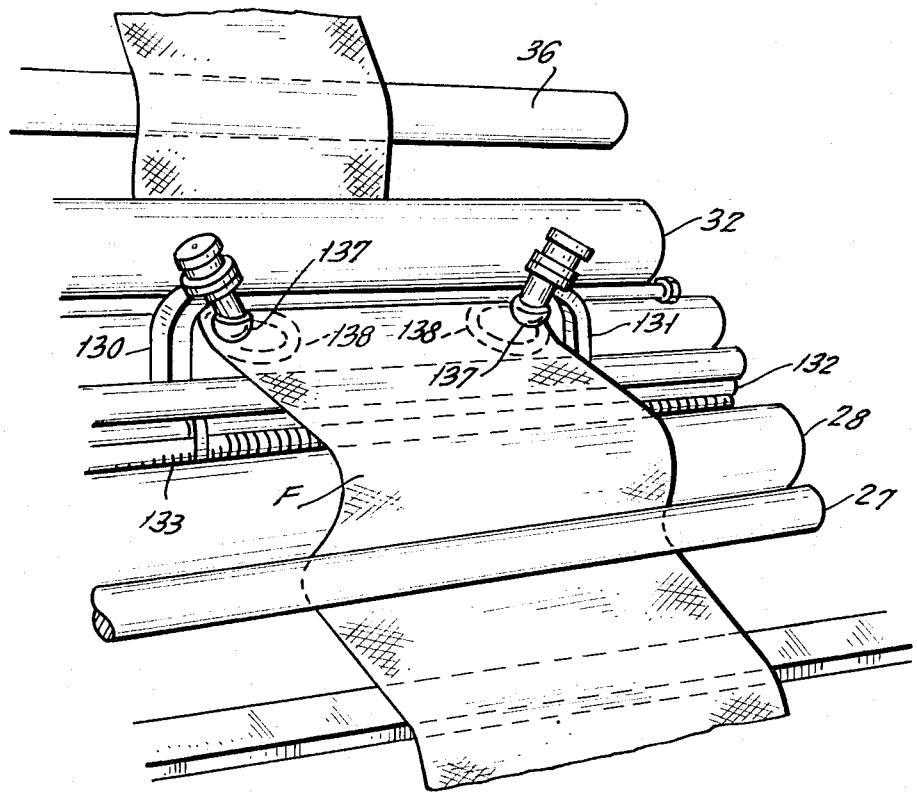
FIG. 6 is a perspective view illustrating an arrangement of ring guide spreader means directly in advance of the dye padding unit.

After the tension bar, the fabric is passed around guide rollers 26, 27 and thence around a power driven entry feed roller 28 forming part of the dye pad unit 29. Positioned immediately downstream of the driven entry feed roller 28 is a ring guide mechanism, generally designated by the numeral 30. The ring guide means, shown in more detail in FIG. 6, are purchased items, known commercially as Sanki Ring Guiders, made available as of the filing data hereof by C. Itoh Textile Machinery Inc., Charlotte, N.C. The ring guide unit 30 is so adjusted that it gently spreads the fabric substantially to, but not substantially beyond, its natural width.

From the exit side of the ring guide unit 30, the fabric F proceeds directly into a solution pan 31 containing a limited quantity of appropriate, premixed dye liquor. Associated with the solution pan are a horizontally opposed pair of front and back squeeze rollers 32, 33, a submerged treating roller 34 and a submerged guide roller 35. Directly above the squeeze rollers 32, 33, spaced vertically therefrom, is an exit guide roller 36. In accordance with one aspect of the invention, the described rollers 32–36 are the only rollers that engage the fabric F as active participants in the dyeing process. This not only enables the apparatus to be kept extremely simple and compact, but also has functional advantages in the processing itself, in that the manipulations of the delicate, two-layered fabric during the critical dyeing phase are kept to an absolute minimum.

After passing the guide roller 36, the fabric is directed upward, over a driven roller 37 forming part of a folder apparatus 38. The folder 38, which may be of conventional design, includes guide means (not shown), for guiding the fabric back and forth and laying it in plaited form in the receiving container 39.

After the dyeing operation has been completed, the fabric typically is sealed against exposure to air for a sufficient time to allow curing of the dye. This may be accomplished by sealing the container 39 itself, or by removing the dyed fabric and placing it in a sealed container or package.

Figure 2:
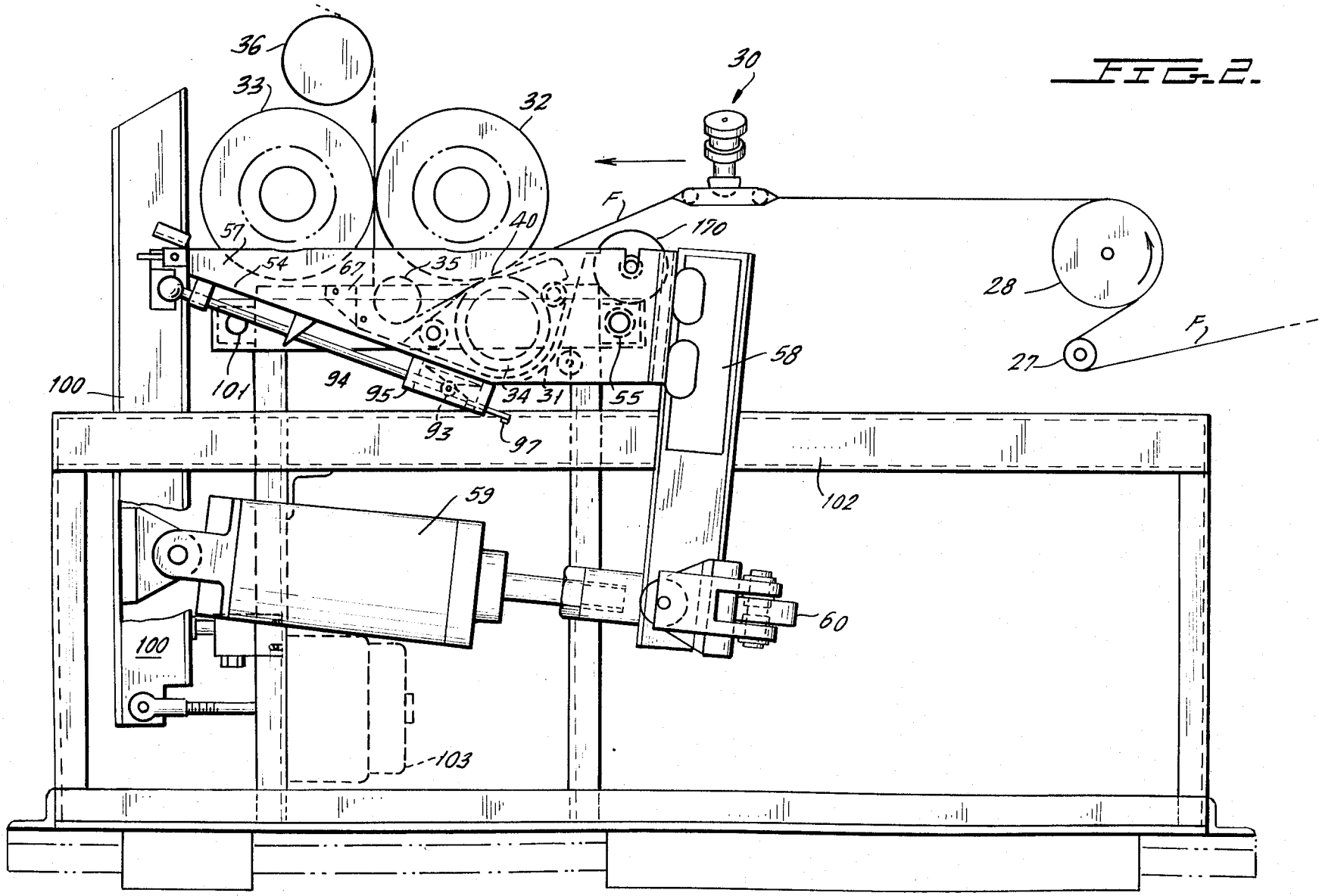
FIG. 2 is an enlarged, broken away view of the dye pad apparatus utilized in the system of FIG. 1.
Figure 3:
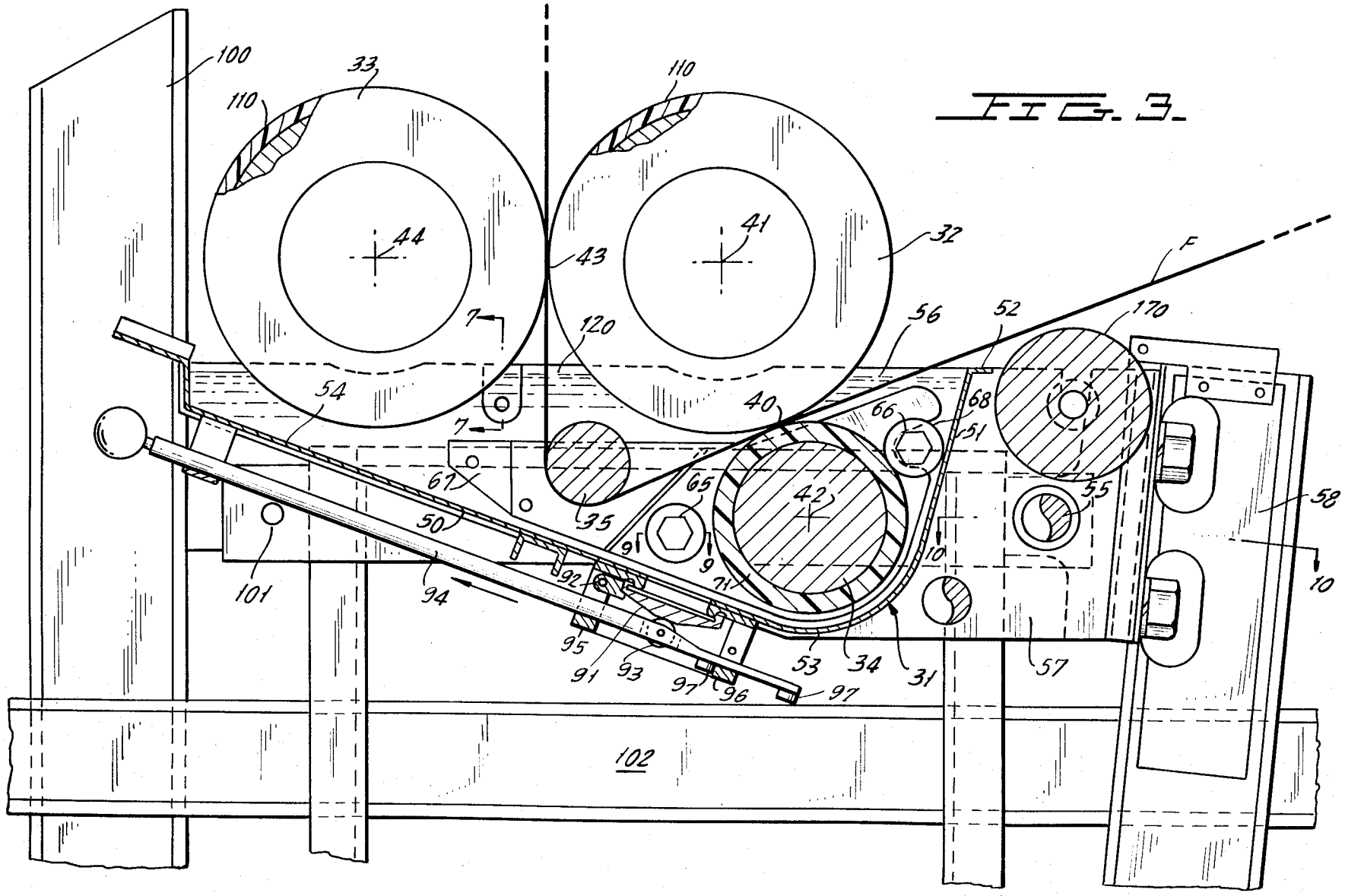
FIG. 3 is a fragmentary enlargement, partly in cross section, illustrating details of construction and arrangement of the processing rollers and solution pan.

Referring now to FIGS. 2 and 3, the entry guide roller 27 is so located, in relation to the driven entry roll 28, as to cause the fabric F to be guided around a substantial portion of the surface of the driven roller 28. That roller is also provided with a relatively high friction surface material, so that the fabric is positively driven thereby, enabling all of the fabric downstream of the entry drive roller 28 to be isolated from forces acting on the fabric upstream of the entry roller. The close coupled relationship of the driven entry roller 28 and the ring guide mechanism 30 assures that the geometrically delicate tubular knitted fabric remains under good control, without excessive twist, for example, that tends to occur with tubular knitted fabric and that might cause wrinkling.

Positioning of the front squeeze roller 32 and the treating roller 34 is such, in relation to the positioning of the ring guide means 30, as to provide for a substantially symmetrical entry of the fabric into the dye nip 40 formed at the line of tangency between the squeeze roller 32 and the treating roller 34. The positioning of the ring guide means is such that the plane of the fabric, as it extends from the ring guide to the dye nip 40 is approximately at right angles to the plane which contains the axes 41, 42 of the front squeeze roller and treating roller. The arrangement is such that the fabric approaches the dye nip 40 more or less symmetrically and does not contact the surface of one of the rollers appreciably in advance of the other. Because of the size differential of the respective rollers 32, 34, the plane of the incoming fabric might in some cases be tilted slightly away from the larger roller to achieve the desired symmetry of surface contact.

In a similar manner, the positioning of the submerged guide roller 35 is such that the fabric is guided symmetrically away from the dye nip 40, redirected vertically, and guided symmetrically up to the squeeze nip 43, which is the line of contact between the respective front and back squeeze rollers 32, 33. Desirably, the axes 41, 44 of the last mentioned rollers are spaced in a horizontal plane, such that the fabric F is vertically oriented in approaching the squeeze nip 43, and remains vertically oriented in exiting from that nip, by reason of the exit guide roller 36.

Pursuant to the invention, the solution pan 31 includes a bottom-forming sheet 50 that conforms relatively closely to the configuration of the wet rollers, those being the two squeeze rollers 32, 33, the submerged treating roller 34 and the submerged guide roller 35. The pan comprises a front wall panel 51 provided with an upper lip-forming flange 52 and which extends downward to a curved transition panel 53 which passes around and under the submerged treating roller 34, in close proximity thereto. The bottom wall 54 of the panel extends rearward in near tangency to the rollers 33, 34. Overall, the solution pan is arranged for a relatively minimum volume of dye liquor and, in a typical machine of approximately sixty inches in width, the available volume of the solution pan typically may approximate eight gallons, for example.

Figure 4:
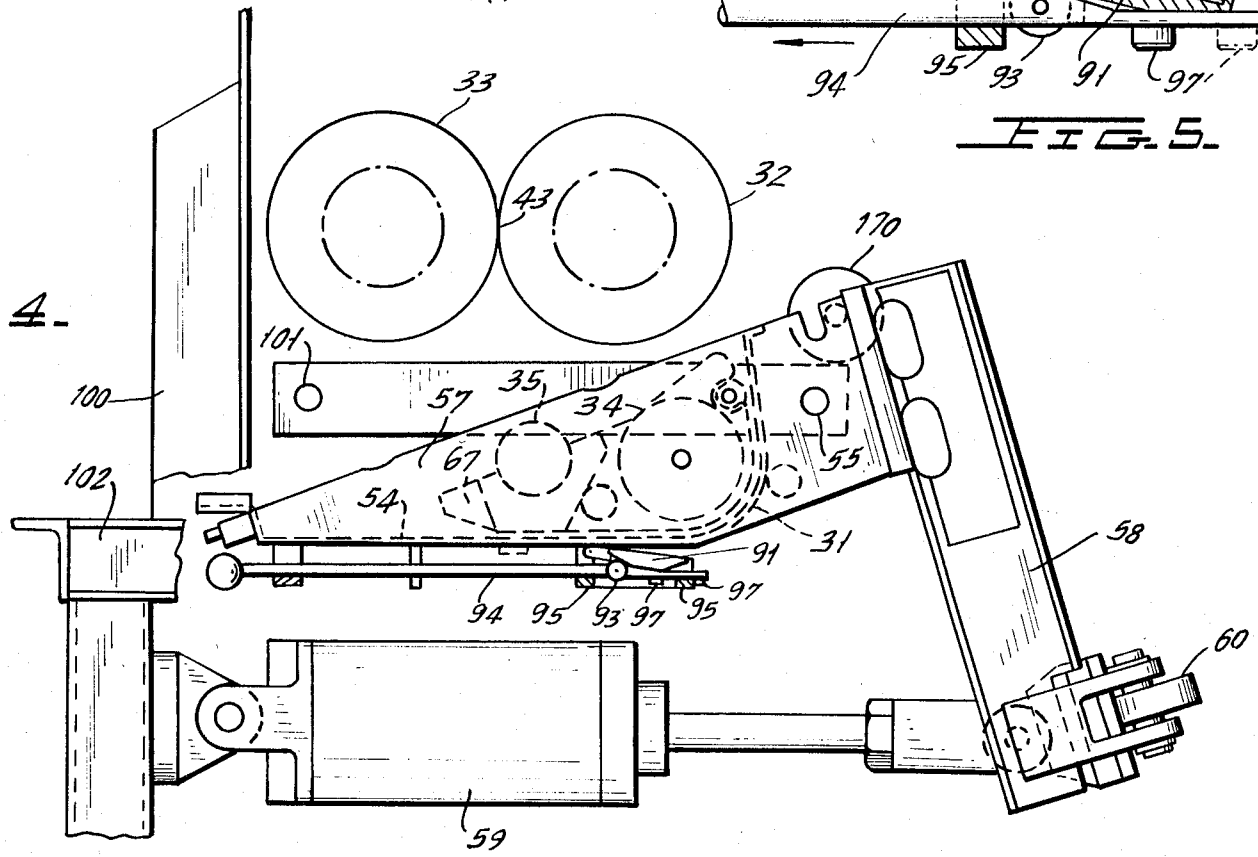
FIG. 4 is a fragmentary illustration of the solution pan mounting, illustrating the pan in a retracted position for clean out of previous treating solutions and threading of a new fabric section.

As a significant feature of the invention, the solution pan 31 is mounted for limited pivoting or tilting movement about the axis of a pivot shaft 55. For this and other purposes to be described, the opposite end walls 56, 57 of the solution pan are formed of relatively heavy metal plate sections, providing a relatively rigid pan structure. The pivot axis provided by the shaft 55 is located in front of the front wall of the pan, enabling the pan to be pivoted between an operative position, as shown in FIG. 3 and a retracted position, as shown in FIG. 4. In the latter position, the rear portion of the pan is tilted downward to a point where the bottom wall 54 is approximately horizontal.

Tilting of the solution pan is enabled by means of lever arms 58 bolted to the respective end panels 56, 57 and extending downward at each side for connection to fluid actuators 59 also mounted at each side of the machine. A rigid cross connecting bar 60 may be provided to assure movement in unison of the two lever arms 58 during tilting movements of the solution pan.

In accordance with the invention, the submerged treating roller 34 and the submerged guide roller 35 are mounted within and journaled by the solution pan itself. Accordingly, the pivoting action of the solution pan serves in one capacity to open the dye nip 40 for initial threading of the equipment and, more importantly, for establishing and maintaining the controlled nip pressure at the dye nip 40. To this end, the respective actuators 59 are provided with variable pressure control means, to be hereinafter described, for maintaining adjustably controllable dye nip pressure.

Pursuant to another significant aspect of the invention, provision is made for removably mounting and supporting the treating roller 34 and guide roller 35 in the solution pan, for easy removal as necessary for maintenance purposes. In addition, the arrangement and mounting of the rolls is such as to minimize the availability of sites for the retention of dye liquor, so that cleaning is facilitated and contamination of subsequent dye lots is reliably avoided. To this end, each of the end plate members 56, 57 has secured thereto by bolts 65, 66 a primary mounting plate 67. To advantage, one of the bolts 65 may be received in through openings in the primary plate 67, while the other bolts 66 may be received in open slots 68. Thus, removal of the entire primary plate assembly, together with the rolls mounted and journaled therein, may be accomplished by removing the bolts 65 and loosening of the bolts 66.

The treating roller 34 desirably is formed of a solid steel core 70 provided externally with an elastomer covering 71, which is bonded to the core surface. The core 70 is recessed at 72 and provided with a suitable bearing sleeve 73 for the reception of a stub shaft 74. The stub shaft 74 are provided at each end, and are received in recessed openings 75 provided in the outer faces of the mounting plates 67. Head flanges 76 are received in the recess openings and, when the mounting plates 67 are secured to the solution end plates 56, 57, are locked in position. Locating pins 77, desirably located directly underneath the stub shafts 74, serve to prevent rotation thereof.

The guide roller 35 desirably is of solid steel construction and is provided at each end with a recess 80 and bearing sleeve 81 for the reception of stub shafts 82. The stub shafts 82 are fixed to secondary mounting plates 83 secured to the primary mounting plates 67 by bolts 84. The arrangement is such that, when the main mounting bolts 65, 67 are removed and loosened respectively, the entire submerged roll assembly, including the primary mounting plates 67, secondary mounting plates 83 and both of the rolls 34, 35 are bodily removable from the solution pan. Further disassembly is possible by removal of the stub shafts 74, detachment of the secondary plates 83, and removal of the stub shafts 82.

Figures 8, 9, 10:
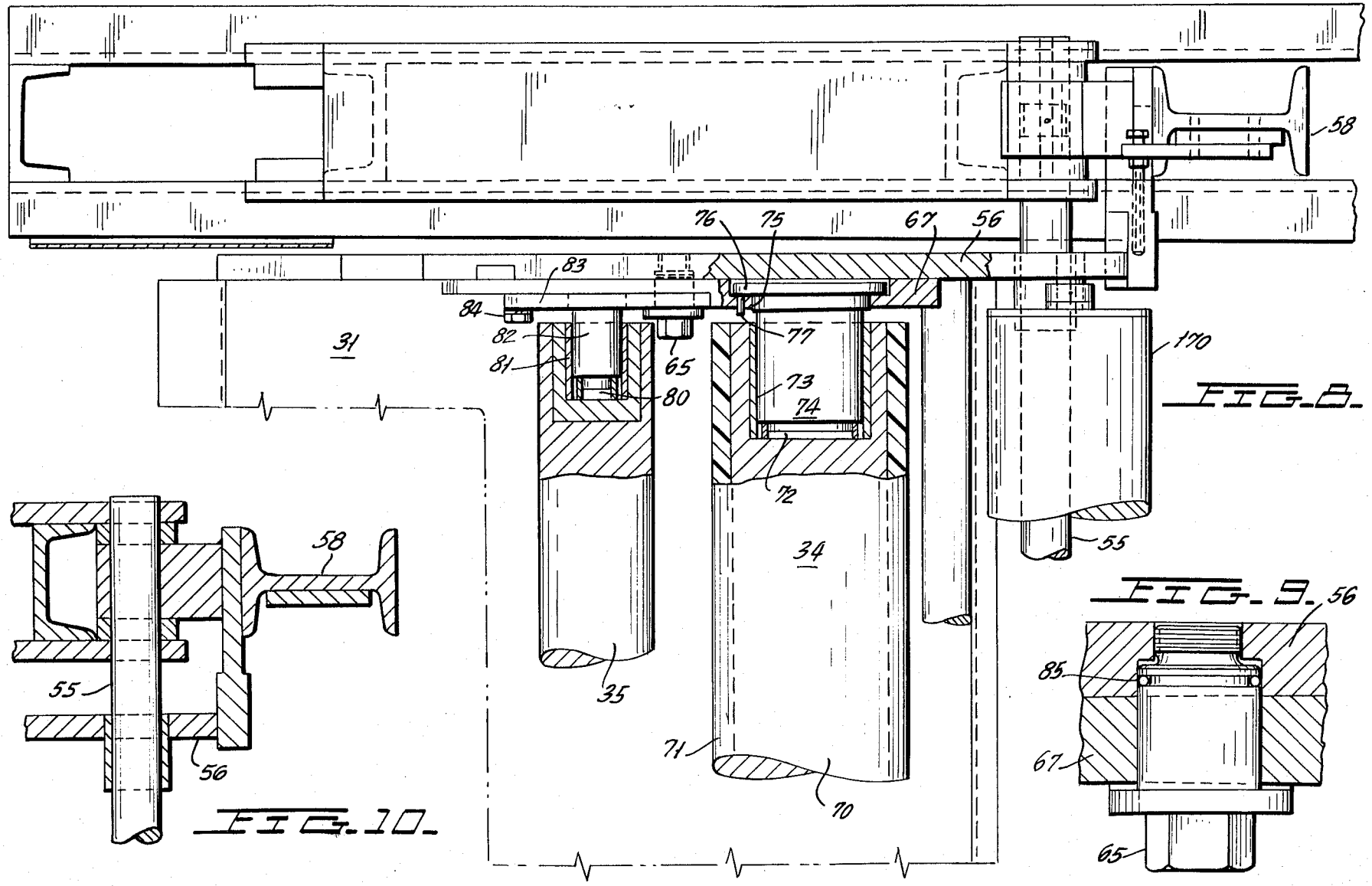
FIG. 8 is a fragmentary top view, partly in section, of the dye pad apparatus, illustrating means for mounting of the solution pan and certain processing and guide rollers.
FIG. 9 is an enlarged, cross sectional view as taken on line 9—9 of FIG. 3.
FIG. 10 is an enlarged, cross sectional view taken on line 10—10 of FIG. 3, illustrating means for pivotally mounting the solution pan.

As shown in FIG. 9, where the mounting bolts 65 are exposed through the outer wall of the solution pan end plates, O-ring seals 85 or the like are provided to avoid leakage of dye liquor.

Figure 5:
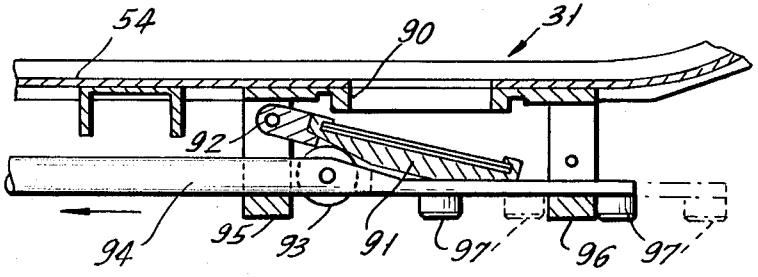
FIG. 5 is a fragmentary detailed cross sectional view, illustrating a drain port arrangement provided in the solution pan.

To assist in cleanout of the solution pan between dye lots, the bottom wall 54 desirably is provided with a drain port 90 closable by a port cover 91. The port cover 91 is hinged at one side 92 and is closable by a cam follower wheel 93 carried by an actuator rod 94 extending rearwardly and manually engageable at the rear of the machine. In the area underneath the port cover 91, the actuating rod is supported by brackets 95, 96 for movement between opening and closing positions as determined by stops 97. When the rod is moved to a forward position, the follower wheel 93 presses upwardly on the cover to force it into a closed and sealed position (see FIG. 3, for example). When the solution pan is tilted downward for clean out, the rod 94 may be pulled rearwardly, freeing the cover 91 to drop to an open position, as shown in FIG. 5. This allows the solution to drain out of the pan and into a suitable catch basin for disposal.

Coaction of the squeeze rollers 32, 33, to provide a controllable pressure nip, is provided by mounting the front squeeze roller 32 on a fixed axis and mounting the back roller 33 on lever arms 100 at opposite sides. Suitable bearing means (not specifically illustrated) mount the back squeeze roller 33 to the lever arms 100, and these arms are in turn pivotally mounted at 101 on the basic machine frame structure 102. Pneumatic actuators 103 engage the lower ends of the lever arms 100 for pivoting the same. The actuators 103 may be spring biased in the opening direction and pressure actuated in the closing direction. Both of the squeeze rollers 32, 33 are formed with steel cores and resilient surface coverings 110. Desirably, the surface coverings 110 are the same as the resilient covering 71 of the treating roller 34, to provide for equal degrees of resilience on opposite sides of the two processing nips 40, 43. A desirable covering material for this purpose is neoprene, having a durameter of approximately 55–60 (Shore A).

Figure 7:
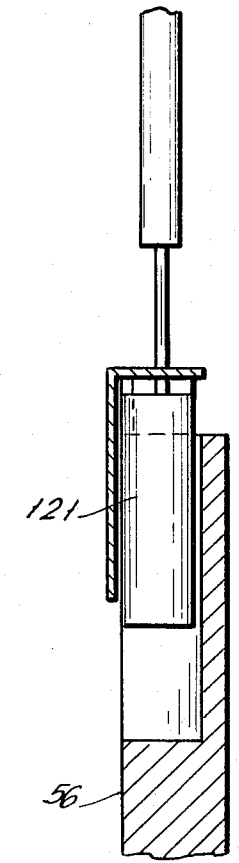
FIG. 7 is a cross sectional view illustrating a control device for maintaining a proper level of treating solution in the solution pan.

Pursuant to the invention, means are provided for maintaining the dye liquor level 120 in the solution pan at a predetermined height, which is well above the lower extremities of the squeeze rollers 32, 33, yet well below the location of the squeeze nip 43. In the illustrated arrangement, the level of the dye liquor advantageously is maintained above the bottom extremities of the rollers 32, 33 a distance equal to approximately one third the radius of the rollers. This may be accomplished by means of the float device 121 (see FIG. 7) recessed in one of the panel end walls 56 and arranged to provide for the inflow of make up liquor when the float drops below a predetermined level. As reflected in FIG. 3, the level thus maintained is such that the dye nip is well submerged, as is the guide roller 35.

The ring guide mechanism, illustrated in FIG. 6 is, per se, a well known and commercially available device. It is a particularly advantageous apparatus of choice for entry control into the dye pad facility. Among other things, the ring guide provides for rapid, substantial change in width positioning. This is particularly useful for pad batch dyeing, where it may be desirable to sew together several strings of tubular knitted fabric, which may vary rather widely in width.

The beforementioned Sanki-type ring guide mechanism involves a pair of brackets 130, 131 mounted on guide rods 132 for lateral sliding movement, and engaged with a drive screw 133 threaded oppositely on either side of center. An air motor 134 (FIG. 11) drives the control screw 133 and the operator, by manipulation of valves 135, 136, can move the brackets 130, 131 rapidly toward or away from each other.

Each of the ring guide brackets carry upper and lower, low friction, rotatable hemispherically shaped elements 137, of which only the upper ones are visible in FIG. 6. Doughnut-shaped ring elements 138 are positioned internally of the tubular knitted fabric F and are confined by the hemispherical elements 137, which, although separated from each other sufficiently to allow the fabric to pass between, are closed to a separation less than the cross sectional diameter of the toroidal rings 138. The fabric is pulled through the ring guide mechanism, which offers little resistance because of its low friction characteristics, but nevertheless requires the fabric to pass outside of the confined ring elements 138, assuring that the fabric is set at a predetermined width, substantially its natural greige width, as it enters the bath of dye liquor.

Figure 11:
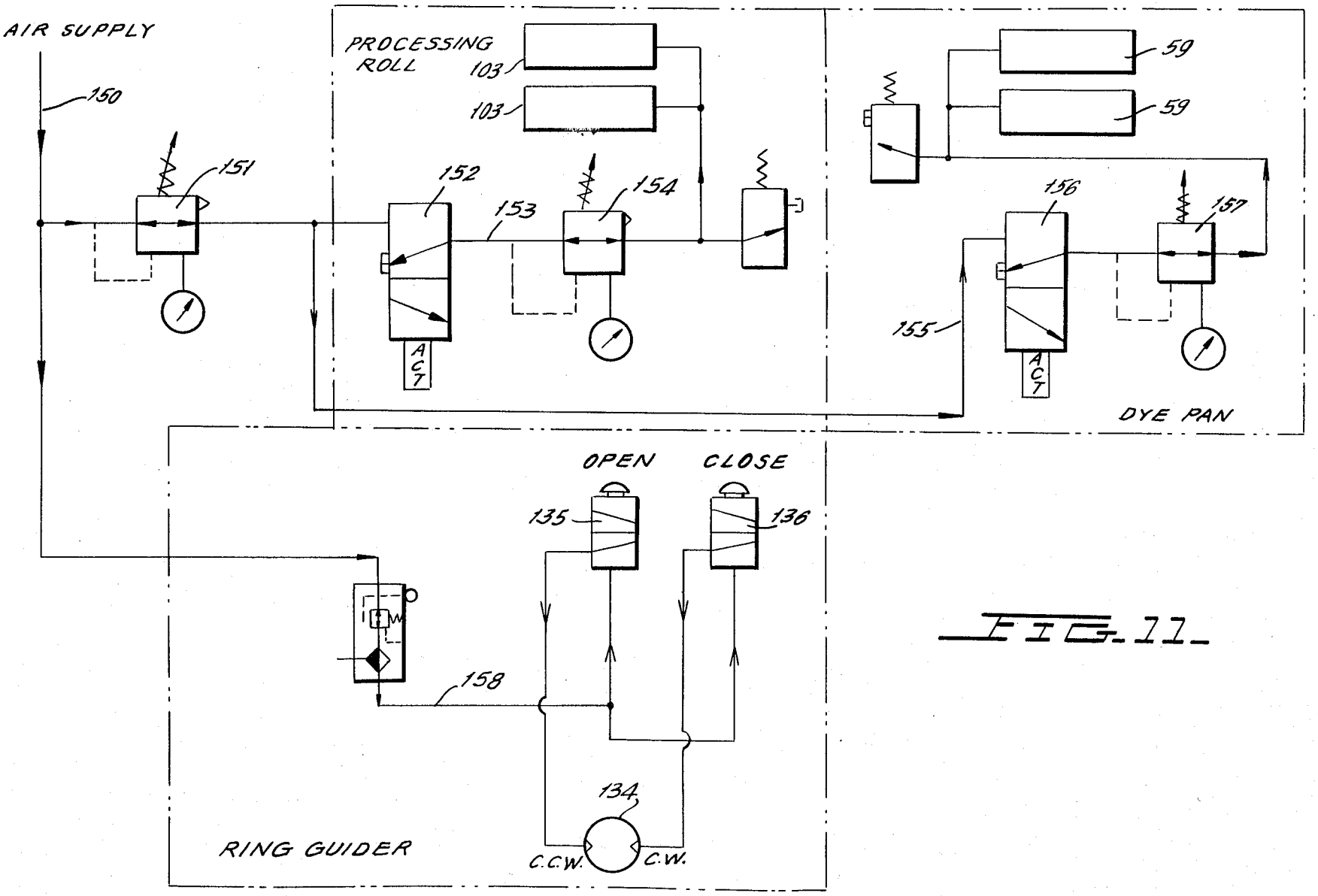
FIG. 11 is a simplified, schematic illustration of typical control facilities for the system of FIG. 1.

Typical operating controls are reflected in FIGS. 1 and 11. In FIG. 1, the reference numeral 140 represents a main drive motor for the system, which advantageously is either a variable speed motor or a constant speed motor with a variable speed transmission device constituting its output. The motor is directly connected to the squeeze rollers 32, 33, and these rollers are positively driven at the same speed, which constitutes the line speed of the system. The entry drive roller 28 is also connected to the main drive motor 140, but through a variable speed device 141, such as an adjustable pulley, enabling the speed of the entry drive roller to be varied slightly above or below line speed. In typical operation, however, the entry feed roller 28 typically will be operating at or very close to line speed.

FIG. 11 illustrates the pneumatic control system utilized in connection with the illustrated apparatus. A plant air supply 150 is connected to a main pressure regulating valve 151, which supplies operating air to the squeeze roller pressure actuators 103 as well as to the solution pan actuator 59. A first remote valve 152 is provided for the squeezing roller actuators 103. When actuated, the valve 152 admits regulated system air into a line 153, through an operator-controlled pressure regulating valve 154 to the actuators 103. By controlling the regulator valve 154, the operator can precisely regulate the pounds per lineal inch of rolling pressure applied at the squeeze nip 43.

Regulated system air is also supplied through a conduit 155 and remote actuated valve 156. When actuated, the valve 156 supplies regulated system air through a manually controlled regulator 157 to the actuators 159 for the solution pan. By operator control of the regulator 157, the pounds per lineal inch of rolling pressure at the dye nip 40 may be regulated by the machine operator.

System air is also provided via line 158 and manually controlled valves 135, 136 to the air motor 134 driving the ring guide adjusting screw 133. By momentarily manually depressing one or the other of the operators for valves 135 or 136, the machine attendant can quickly adjust the ring guiders inward or outward, to adjust fabric width as necessary.

SUMMARY OF OPERATION

In preparation of a pad batch dyeing operation, a batch of fabric is readied by sewing together as many lengths of tubular knitted fabric as is appropriate to the operation. The connected lengths may, but need not be, of uniform width nor even of uniform fiber composition as long as a common dye lot would be appropriate for the differently composed fabric.

The starting fabric will be of either 100% cotton content, or a substantial percentage of cotton, typically 50% or more. The fabric is in dry form, and may have been subjected to previous bleaching or scouring operations. With currently available dyestuffs, however, it is often feasible to treat the fabric in its greige form, and there are economic advantages to doing so when practicable.

The fabric is plaited into the supply container 20 and then threaded through the dyeing machine and into the folder 38. At this time, the solution pan 31 is in its retracted or downwardly tilted position, providing easy access for initial threading of the fabric string. Usually a suitable leader is attached to the front of the fabric string to avoid wastage of the section extending from the dyeing pad 29 into the receiving container 39 for commencement of the dyeing process.

During setup of the equipment, a batch of fiber reactive dyestuff is prepared. When the dyeing operation commences, the dyestuff is mixed with alkali in a ratio of approximately four parts dye solution to one part alkali. However, since the stability of the dye solution after addition of the alkali may be extremely short, the dye solution and the alkali are stored in separate containers until the moment that the dye liquor is to be pumped to the solution pan 31. At that time, the dye and alkali solutions are pumped out of their respective vats in premeasured proportions, mixed, and delivered to the solution pan as by means of a shower pipe 160 (FIG. 1).

When the operation is ready to commence, the solution pan 31 is pivoted to its upward or operating position, and the pressure regulators 154, 157 are adjusted by the operator to provide the desired working pressure at the respective dyeing and squeezing nips 40, 43. The dye solution is then mixed and pumped into the solution pan until a full condition is indicated by the sensing float 121, at which time the operator actuates the drive motor 140 causing the fabric to be advanced through the dye solution and conveyed to the folder 38 and receiving container 39.

At the startup, the operator observes the condition of the fabric at the ring guide unit 30 and in the area between the entry drive roller 28 and the solution pan 31, making the necessary fine tuning adjustments so that the fabric is smooth and flat, but not overdistended laterally, and not subject to a tendency to twist or edge curl in the region between the entry feed roller 28 and the dye nip 40.

As reflected in FIG. 3, as the fabric F approaches the dye nip 40, it first enters the dye solution, the level of which is indicated at 120. The fabric travels only a few inches through the solution before entering the dye nip 40, where the fabric is squeezed lightly between the front squeeze roller 32 and the treating roller 34. Typically, the regulator valve 157 may be adjusted to provide for around 40 to 60 pounds per lineal inch at the dye nip. This serves to squeeze the tubular fabric flat, expressing any residual air content therefrom, which bubbles up to the surface of the dye solution in the area in front of the dye nip.

The submerged treating roller 34, in the apparatus of the invention, is driven via surface-to-surface contact with the front squeeze roller 32, through the interposed fabric F. These rollers are provided with resilient coverings 71, 110 of similar hardness to avoid distortion of the fabric, from one side to the other at the submerged dye nip.

As the fabric emerges on the downstream side of the dye nip, it is guided away from the nip more or less symmetrically with respect to the respective rollers 32, 34, so as to assure substantially equal exposure of both sides of the fabric tube to the dye solution. Release of the fabric from the rolling pressure of the dye nip provides somewhat of a "sponge" action, drawing some of the dye liquor into the fibers and assuring through penetration.

After a few inches of additional travel downstream of the dye nip 40, the fabric is guided around the freely rotating guide roller 35. This roller is positioned so that the fabric is guided vertically upward therefrom to the squeeze nip 43, again such that the fabric is symmetrically related to the opposed squeeze rolls and does not contact the surface of one of them significantly in advance of the other.

As shown in FIG. 3, the location of the dye solution surface is several inches below the squeeze nip 43. As the fabric travels upwardly toward the squeeze nip, clinging solution is allowed to cascade down along the size of the fabric tube, along with excess dye solution that is being squeezed out at the squeeze nip itself.

In a typical operation, the pressure regulator 154 is adjusted to provide a squeeze nip pressure generally in the range of 60 to 80 pounds per lineal inch. This pressure is adjusted by the operator to achieve a desired level of pickup of the dye solution. In a typical case, the dye pickup may approximate 100% by weight of the weight of the dry fabric. With the addition of chemical aids, the amount of pickup may be increased in some cases to as much as 120–140%.

As the fabric emerges from the squeeze nip 43, it is guided symmetrically away from the rollers 32, 33, by the guide roller 36. This prevents, insofar as practicable, contact of the fabric with the "rings" of dye solution which remain on the surface of the squeeze rollers 32, 33 immediately outside of the fabric edges. The fabric can then be diverted by the guide roller 36 to the folding apparatus 38.

In a typical commercial dyeing operation, speeds of 40 to 50 yards per minute are readily obtainable, and it is contemplated that experienced operators may be able to achieve speeds of up to 75 yards per minute without difficulty.

Because of the small capacity of the solution pan 31, it is necessary to replenish the dye solution continually during a dyeing operation, and this is done under the control of the float switch 121, as will be understood.

When the dye batch has been completed, the dyed fabric is immediately sealed to minimize exposure to air, and allowed to cure for a period of time, perhaps as long as a day or more, in accordance with known techniques.

At the conclusion of a dye batch, the actuators 59 are reversed to tilt the solution pan 31 to its retracted position, as shown in FIG. 4, and the port cover 91 is opened to permit draining of the remaining dye solution. The supply system, solution pan and rollers are then thoroughly rinsed down with fresh water to remove all traces of the old dye. With trained operators, the entire line can be readied for a new dye batch in about a half hour, readily accommodating the running of several dye lots in a day's production, if desired.

In the processing of all-cotton fabrics a single pass is sufficient to complete the dyeing operation. With cotton-polyester blends, on the other hand, different dyes are required for dyeing of the polyester and the cotton and, if both components are to be dyed, separate operations are carried out.

Although the apparatus of the invention is designed for the processing of tubular knitted fabrics, and its significant inventive features are utilized to advantage in connection with such fabrics, it is also possible to treat open width fabrics of a heavier, more geometrically stable construction using the new apparatus. In such cases, the ring guide equipment will be retracted completely to the side, and one or more strings of open width fabric are guided over the top surface of an entry guide roller 170. As is evident in FIGS. 1 and 3, the positioning of the entry guide roller 170 is slightly below the plane of the fabric as it normally is conveyed from the ring guide unit 30 to the dye nip 40 such that, in the normal processing of tubular knitted fabric, the entry guide roller 170 is not in contact with the fabric. Similarly, for certain narrow width, heavy gauges of tubular knitted fabrics, it may be feasible to process side-by-side multiple strings, without using the ring guiders, in which case the fabric would be guided into the dye bath over the top of the entry guide roller 170 in a fashion similar to open width material.

Among the important advantages of the apparatus of the invention are the extraordinary simplicity of the arrangement of active processing rolls, comprising horizontally opposed squeeze rollers, a single submerged treating roller forming a single submerged dye nip, and a single submerged guide roller. The equipment is thus mechanically extremely simple, relatively economical to manufacture and install as well as to maintain. Moreover, and perhaps more importantly, the fabric is acted upon by only two roller nips during the dyeing operation, providing minimum opportunity for the fabric to be damaged at the edges or distorted by excessive mechanical contact. Effective exposure of the fabric to dye chemicals is provided by guiding the fabric substantially symmetrical to and away from the submerged dye nip, and also to the squeeze nip 43. Symmetrical guidance of the fabric away from the squeeze nip helps to prevent the likelihood of edge marking, that might otherwise result from excessive contact with the "rings" of dye solution at the sides of the squeeze rollers.

Significantly, the submerged treating roller 34 is mounted within and by the solution pan, so that closing of the dye nip and maintaining of working pressure thereon is controlled exclusively by means of actuator means acting on the solution pan itself. An extraordinarily simple and effective arrangement is thus provided. In addition, especially important for batch operations, the solution pan may be quickly tilted downward at the end of a dye operation, not only providing for the rapid draining and clean up of the used dye liquor, but also opening the dye nip for easy cleaning and more expeditious threading of a new fabric string.

A significant aspect of the process is the provision of a controllably driven entry feed roller, which engages the fabric across its width and isolates it from uneven tension forces that may be acting on the fabric in the process of drawing it from the supply container. The driven entry feed roller is in close coupled relation to a ring guide mechanism, which is in turn in close coupled relation with the single submerged dye nip of the dye pad apparatus. This arrangement enables tubular knitted fabric, which is notoriously geometrically unstable, to be delivered to the dye nip free of wrinkles and curled over edges and of a geometrically stable width. The fabric thus delivered to the dye nip is in ideal condition for the steps necessarily involved in the dyeing process, which include pressure rolling operations at the dye nip and at the subsequent squeeze nip.

The configuration of active processing rollers is, according to the invention, such that the solution pan is maintained at a very low volumetric capacity, arranged to hold only a limited quantity of the dye solution. Not only does this result in overall savings in dye utilization, but it assures that the dye solution will be used in a very short period of time after delivery to the solution pan, before becoming unstable.

The procedures of the invention enable significant reductions in dyeing costs per pound of fabric, resulting from substantial savings in chemical consumption and water, energy and labor utilization. In addition, as compared to beck or jet dyeing, for example, there is significantly less physical degradation of the fabric. The process of the invention enables improved uniformity of dye shade, from lot to lot, with outstanding repeatability. At the same time, the resulting processed fabric has an improved hand and appearance. The procedure also is advantageous in its ability to effectively dye fabric in greige condition, without scouring or bleaching.

It should be understood, of course, that the forms of the invention herein specifically illustrated and described are intended to be representative only, as certain changes may be made therein without departing from the clear teachings of the disclosure. Accordingly, reference should be made to the following appended claims in determining the full scope of the invention.

I claim:

1. Apparatus for pad batch dyeing of tubular knitted fabric, which comprises (a) means for supplying the tubular knitted fabric in generally flat form and under a relatively minimum lengthwise tension, (b) a driven entry roller, (c) means to guide the supplied tubular knitted fabric around a portion of the entry roller whereby the fabric is advanced under the control of the entry roller, (d) width-adjustable ring guide means positioned immediately downstream of and in close coupled relation to said entry roller, (e) said ring guide means engaging the tubular knitted fabric internally by its opposite edges and guiding said edges, (f) said ring guide means being laterally adjustable to enable said tubular knitted fabric to be maintained at a relatively uniform width not significantly greater than its natural width, (g) a dyeing-extracting means arranged downstream of and in close coupled relation to said ring guide means, (h) said dyeing-extracting means comprising a pair of front and back resilient squeeze rollers mounted on parallel, horizontally spaced axes, (i) a solution pan mounted below said squeeze rollers and adapted to contain a treating solution at a level below the axes of said squeeze rollers and above the lower extremities of said rollers, (j) a resilient dye roller mounted in said solution pan in submerged relation to the solution contained therein and in resilient contact with said front squeeze roller to form a dye nip, (k) a guide roller mounted in said solution pan in submerged relation to said said solution for redirecting said fabric to exit from said solution upwardly to the squeeze nip formed by the line of contact between said squeeze rollers.

2. Apparatus according to claim 1, further characterized by (a) said dye roller being mounted within and by said solution pan, (b) means mounting said solution pan for pivoting movement about an axis parallel to said front squeeze roller, and (c) variable pressure means for pivoting said pan into and out of operating position and maintaining said dye roll in controlled pressure engagement with said front squeeze roller when said pan is in operating position.

3. Apparatus according to claim 2, further characterized by (a) said guide roll being mounted within and by said solution pan.

4. Apparatus according to claim 3, further characterized by (a) said guide roll and said ring guide means defining an entry plane for guiding said fabric into said solution pan, (b) said entry plane being substantially at right angles to the plane defined by the axes of said front squeeze roller and said dye roller.

5. Apparatus according to claim 3, further characterized by (a) said guide roller being so positioned in relation to the nip formed by said squeeze rollers that the generally vertical plane extending through said nip and tangent to said guide roller is substantially at right angles to the plane defined by the axes of said squeeze rollers.

6. Apparatus according to claim 5, further characterized by (a) secondary guide roller means mounted above said squeeze rollers and in tangential relation to said generally vertical plane.

7. Apparatus for pad batch dyeing of tubular knitted fabric, which comprises (a) means for supplying the tubular knitted fabric in generally flat form and under a relatively minimum lengthwise tension, (b) a driven entry roller, (c) means to guide the supplied tubular knitted fabric around a portion of the entry roller whereby the fabric is advanced under the control of the entry roller, (d) a dyeing-extracting means arranged downstream of and in relatively close coupled relation to said driven entry roller, (e) said dyeing-extracting means comprising a pair of front and back resilient squeeze rollers mounted on parallel, horizontally spaced axes, (f) a solution pan mounted below said squeeze rollers and adapted to contain a treating solution at a level below the axes of said squeeze rolls and above the lower extremities of said rollers, (g) a resilient treating roller mounted in said solution pan in submerged relation to the solution contained therein and in resilient contact with said front squeeze roller to form a dye nip, (h) a guide roller mounted in said solution pan in submerged relation to said said solution for redirecting said fabric upwardly to exit from said solution upwardly to the squeeze nip formed by the line of contact between said squeeze rollers.

8. Apparatus according to claim 7, further characterized by (a) fabric guide means positioned between said driven entry roller and said front squeeze roller, (b) said guide means defining with said submerged guide roller a plane passing through said dye nip substantially at right angles to the plane defined by said front squeeze roller and said dye roller.

9. Apparatus according to claim 8, further characterized by (a) said fabric guide means comprising a guide roller for engaging the lower surface of the flat fabric.

10. Apparatus according to claim 8, further characterized by (a) said fabric guide means comprising ring guide means, and (b) means for adjusting the width of said ring guide means to bring said fabric substantially to its natural width before said fabric enters said solution.

11. Apparatus according to claim 7, further characterized by (a) adjustable means mounting said solution pan for movement toward and away from said squeeze rollers, (b) said adjustable means providing for controllable contact pressure between said dye roller and said front squeeze roller.

12. Solution treating apparatus for tubular knitted fabric and the like comprising (a) a pair of front and back resilient squeeze rollers mounted on parallel, horizontally spaced axes and arranged in contacting relation to form a squeeze nip, (b) a solution pan pivotally mounted below said squeeze rollers, (c) means for pivoting said solution pan between operative and retracted positions, (d) solution level control means operative when said solution pan is in operative position to maintain solution at a level above the bottoms of said squeeze rollers and below said squeeze nip, (e) a resilient treating roller mounted within and by said solution pan and in position to contact said front squeeze roller to form a submerged treating nip when said solution pan is in an operative position, (f) controllable means for holding said solution pan in operative position while maintaining a predetermined, controllable working pressure at said treating nip, (g) guide roller means mounted within and by said solution pan below the level of said treating solution, (h) said guide roller guiding said fabric first away from said treating nip and then toward said squeeze nip.

13. Apparatus according to claim 12, further characterized by (a) a pair of opposed mounting plates removably secured in said solution pan, on opposite side walls thereof, (b) said treating roller and said guide roller being journalled by said mounting plates and being removable from said pan upon removal of said mounting plates.

14. Apparatus according to claim 12, further characterized by (a) said guide roller being so positioned in relation to said squeeze rollers and said treating roller that fabric is guided away from said dye nip in substantially symmetrical relation to the respective rollers forming said dye nip, and (b) a generally vertical guide plane defined by said guide roller and said squeeze nip is substantially at right angles to the plane defined by the axes of said squeeze rollers.

15. Apparatus according to claim 14, further characterized by (a) entry guide means positioned in front of said solution pan and operative to guide said fabric substantially symmetrically toward said treating nip, and (b) exit guide means positioned above said squeeze nip and substantially in said generally vertical guide plane and operative to guide said fabric away from said squeeze nip.

16. Apparatus according to claim 15, further characterized by (a) said entry guide means comprising adjustable width ring guide means engageable internally with with edges of said tubular knitted fabric to spread said fabric substantially to its natural width immediately in advance of its entry into said treating solution.

17. Apparatus according to claim 16, further characterized by (a) fabric feeding means being provided in front of said entry guide means, (b) said fabric feeding means comprising a driven feed roller engageable with the fabric immediately in advance of said ring guide means, (c) means being provided for driving said squeeze rollers in predetermined speed relation to said driven feed roller whereby to maintain said fabric in a relatively tension free condition from said ring guide means to said treating nip.

18. Apparatus according to claim 17, further characterized by (a) said treating roller being of a resiliency similar to that of the front squeeze roller and being driven thereby through surface-to-surface contact through the intervening fabric.

19. Apparatus according to claim 12, further characterized by (a) said solution pan having a width slightly greater than said squeeze rollers to enable said rollers to be partially received in said pan, (b) the bottom of said pan closely embracing said treating roller and extending upward and rearward from said treating roller to said back squeeze roller in near tangency thereto when said pan is in an operative position.

20. Apparatus according to claim 19, further characterized by (a) said pan being mounted for pivoting movement about an axis located forward of the plane defined by the axes of said front squeeze roller and said treating roller.

21. Apparatus according to claim 12, further characterized by (a) there being only one resilient treating roller in said solution pan, and (b) there being only one submerged guide roller mounted in said pan.

* * * * *